US005357260A

United States Patent [19]

Roederer et al.

[11] Patent Number: 5,357,260

[45] Date of Patent: Oct. 18, 1994

[54] ANTENNA SCANNED BY FREQUENCY VARIATION

[76] Inventors: Antonine Roederer, Breloftpark 32, Noordwijk; Markus Kari, Prof. Aalberslaan 11, Noordwijkerhout, both of Netherlands

[21] Appl. No.: 5,880

[22] Filed: Jan. 15, 1993

Related U.S. Application Data

[63] Continuation of Ser. No. 720,081, Jun. 24, 1991, abandoned.

[30] Foreign Application Priority Data

Jul. 10, 1990 [FR] France ..... 90 08743

[51] Int. Cl.[5] ..... H01Q 3/22; H01Q 15/23; H01Q 11/02

[52] U.S. Cl. ..... 343/754; 343/771; 343/781 P; 343/840; 343/909; 343/739

[58] Field of Search ..... 343/731, 739, 770, 771, 343/754, 909, 755, 781 P, 757, 757 E, 776, 840; H01Q 13/20, 3/00, 3/01, 3/26, 3/34, 3/44, 3/46

[56] References Cited

U.S. PATENT DOCUMENTS

| | | | |
|---|---|---|---|
| 3,018,480 | 1/1962 | Thourel | 343/771 |
| 3,311,917 | 3/1967 | Thourel | 343/771 |
| 3,419,870 | 12/1968 | Wong | 343/768 |
| 3,560,970 | 2/1971 | Kamimura et al. | 343/771 |
| 4,458,250 | 7/1984 | Bodnar et al. | 343/768 |
| 4,479,128 | 10/1984 | Brunner et al. | 343/756 |

FOREIGN PATENT DOCUMENTS

| | | | |
|---|---|---|---|
| 2619658 | 8/1988 | France | 343/771 |
| 1101939 | 7/1984 | U.S.S.R. | 343/754 |
| 2221800 | 2/1990 | United Kingdom | H01Q 13/20 |

OTHER PUBLICATIONS

G. von Trentini, Partially Reflecting Sheet Arrays, IRE Trans. on Ant. & Prop., Oct. 1957, pp. 666–671.

Bahl et al., Leaky-Wave Antennas Using Artificial Dielectrics at Millimeter Wave Frequencies, IEEE Trans. on Microwave Theory & Tech., vol. MTT-28, No. 11, Nov. 1980, pp. 1205–1212.

Croney, J., Microwave Journal "Doubly Dispersive Frequency Scanning Antenna (For Two Plane Scanning)", vol. 6, No. 7, Jul. 1963, pp. 76–80.

Ando, M., et al., "Design of a Radial Line Slot Antenna with Improved Input VSWR", Electronics and Communications in Japan, vol. 71, No. 9, Sep. 1988, pp. 76–90.

*Primary Examiner*—Rolf Hille
*Assistant Examiner*—Peter Toby Brown
*Attorney, Agent, or Firm*—Ron Fish

[57] ABSTRACT

An antenna scanned by frequency variation, comprising: exciter means for producing a plane electromagnetic wave at a given frequency which is variable about a center frequency; and radiating means receiving the plane wave produced by the exciter means and subjecting the plane wave to a plurality of successive reflections, the radiating means including means for allowing a fraction of the plane wave to leak to the outside after each successive reflection in order to enable it to radiate to the outside; the phase shift of the wave between two reflections varying as a function of the frequency of the wave and the set of radiated waves produced in this manner thus having a determined relative phase difference, which is variable as a function of the frequency of the wave generated by the exciter means and which defines transmission having a main lobe whose direction is itself variable as a function of the said frequency. Preferably the radiating means include two facing surfaces, one of which surfaces constitutes a ground surface and the other of which surfaces constitutes a radiating front surface which is permeable to the electromagnetic waves, the antenna further including means for injecting a plane wave at a predetermined angle of incidence between the two surfaces. The invention is particularly suitable for satellite antennas.

9 Claims, 3 Drawing Sheets

ANTENNA SCANNED BY FREQUENCY VARIATION

This is a file wrapper continuation application of a U.S. patent application Ser. No. 07/720,081, filed Jul. 24, 1991, now abandoned, for AN ANTENNA SCANNED BY FREQUENCY VARIATION.

The present invention relates to an antenna scanned by frequency variation, i.e., an antenna that transmits (or receives) an electromagnetic wave with a radiation pattern whose main lobe extends in a given direction which is variable as a function of the frequency of the wave radiated (or received) by the antenna.

Purely static scanning can thus be achieved electronically merely by selecting the exact frequency applied to the antenna, with each frequency selectable in this way corresponding to a particular main transmission direction.

BACKGROUND OF THE INVENTION

Various structures are known that enable such a function to be implemented, in particular waveguide structures such as those described in the work entitled *Radar Handbook,* 1970, edited by M. Skolnik, and in particular chapter 13 entitled *Frequency-Scanned Arrays* by Irving W. Hammer which describes, in particular, slot arrays and structures having folded radiating elements enabling such electronic scanning to be implemented by frequency variation.

French patent publication FR-A-2 535 120 in the name of the present Applicant also describes a frequency-sensitive reflector element which, when placed in front of a wave launcher such as a transmitter horn serves to reflect the incident wave in a direction that varies as a function of the frequency of said wave.

However, all of these devices suffer from various common drawbacks, namely:

- their scanning ability (i.e., the amplitude of the angular variation in the direction of the main lobe as a function of the maximum relative frequency variation) is generally very limited, and insufficient in numerous applications;
- their structure is always complex both from the mechanical point of view and from the radio point of view, thereby making design and manufacture difficult, and therefore expensive;
- these complex structures are generally massive and voluminous, which makes them ill-suited for use as satellite antennas; and
- the shapes of the radiation patterns produced are such that on changing frequency, the degree of overlap between two successive beams (i.e., the level in a direction halfway between the main transmission directions of two successive beams) is generally relatively low, thereby making it difficult to obtain continuous coverage of a given geographical area.

An object of the invention is to provide a frequency-scanned antenna which remedies all of these drawbacks, thereby making it entirely suitable for use as a satellite antenna, in particular as an antenna for satellite communication.

It is shown that from the mechanical point of view, the structure of the antenna of the invention is simultaneously simple, compact, and lightweight, all of which characteristics are particularly desirable for use on a satellite.

It is also shown that the scanning ability of the proposed structure as a function of frequency is highly sensitive to frequency, i.e., a relatively large scanning amplitude is obtained for a small variation in frequency.

This characteristic is particularly advantageous since the permitted frequency excursion is generally limited by the specific characteristics of the transmitter by microwave bandwidth allocations, e.g., in the 30/20 GHz bands used for satellite communications where bandwidth is typically about ±2.5% around the center frequency. With frequency excursion limited in this way, it is desirable to be able to cover as wide a geographical area as possible while remaining within these frequency limits. This is a characteristic which the present invention specifically provides, together with the possibility of easily establishing by construction the most appropriate frequency sensitivity given the desired geographical coverage, merely by selecting simple geometric parameters.

It is also shown that the antenna of the invention is entirely compatible with various common constraints such as:

(1) high power can be radiated at high efficiency;
(2) polarization linearity is maintained;
(3) circular polarization may optionally be used;
(4) the structure is robust, and suitable for withstanding the severe stresses of the space environment; and
(5) maximum insensitivity exists to temperature variation, which is particularly useful given the very large amplitude temperature cycles encountered in the space.

SUMMARY OF THE INVENTION

The present invention provides an antenna scanned by frequency variation and comprises: exciter means for producing a plane electromagnetic wave at a given frequency which is variable about a center frequency; and radiating means receiving the plane wave produced by said exciter means and subjecting the plane wave to a plurality of successive reflections, said radiating means including means for allowing a fraction of the plane wave to leak to the outside after each successive reflection in order to enable it to radiate to the outside; with the phase shift of the wave between two reflections varying as a function of the frequency of the wave and the set of radiated waves produced in this manner thus having a determined relative phase difference, which is variable as a function of the frequency of the wave generated by the exciter means and which defines transmission having a main lobe whose direction is itself variable as a function of said frequency.

Preferably, the radiating means include two facing surfaces, one of which constitutes a ground surface and the other of which constitutes a radiating front surface which is permeable to the electromagnetic waves, e.g., by means of perforations, the antenna further including reflector means for injecting a plane wave at a predetermined angle of incidence between the two surfaces.

Most advantageously, the permeability of the front surface varies over that surface, with its permeability being low in near regions where the power density of the plane wave is high, and being high in far regions where said density is lower.

The exciter means may comprise two facing surfaces together with electromagnetic wave transmitter means disposed in such a manner as to direct said transmitted electromagnetic waves between the two surfaces, with at least one focusing reflector member connecting the exciter means to the reflector means.

In a first embodiment, the facing surfaces of the exciter means and the facing surfaces of the radiating means extend in essentially parallel directions, the focusing reflector member being disposed at the same end of the exciter means and of the radiating means, in such a manner as to reflect the wave transmitted to said end of the exciter means towards the adjacent end of the radiating means at said predetermined angle of incidence.

In a second embodiment, the facing surfaces of the exciter means and of the radiating means extend over directions that are at an angle to each other, which angle is equal to a right angle plus said predetermined angle of incidence, thereby enabling the radiating means to be fed directly with the plane wave produced by the exciter means.

In addition, to enable two-directional scanning, the exciter means may advantageously include means for selectively producing different beams having respective different directions varying in a direction perpendicular to said direction in which the main lobe varies as a function of frequency.

BRIEF DESCRIPTION OF THE DRAWINGS

Embodiments of the invention are described by way of example with reference to the accompanying drawings, in which.

DETAILED DESCRIPTION

Figure 1:
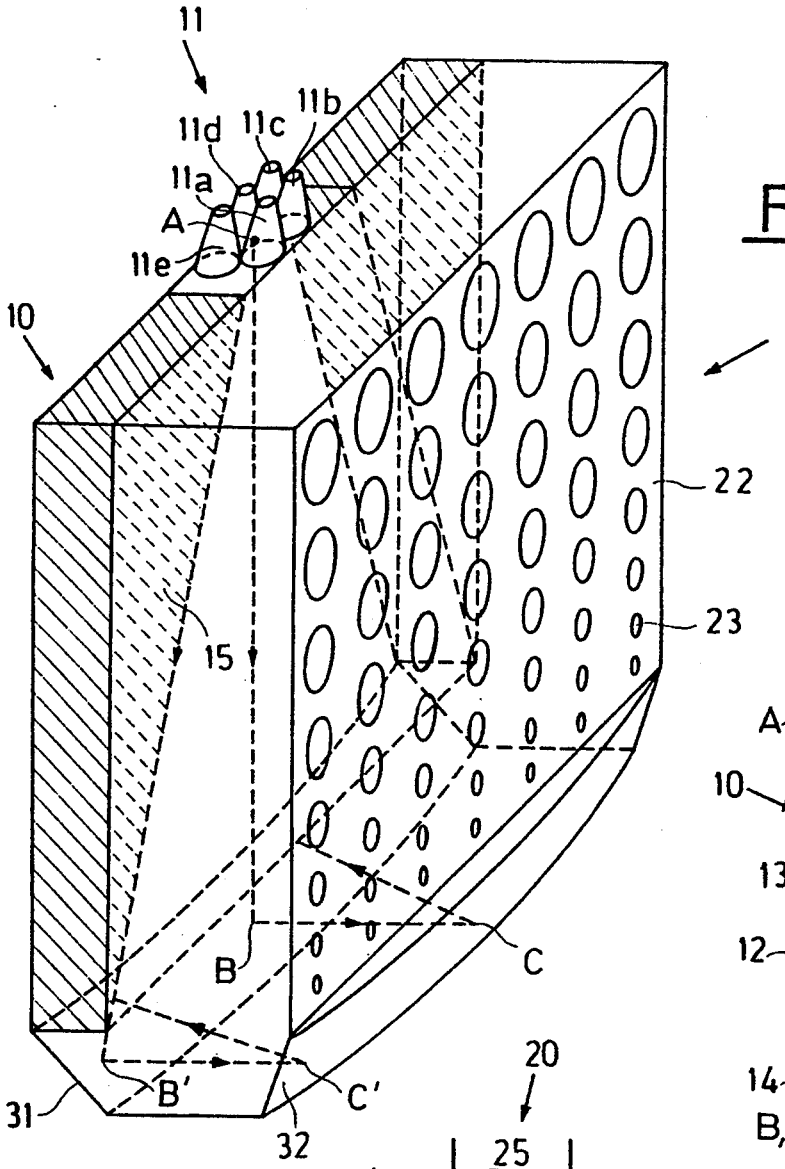
FIG. 1 is a perspective view of a first embodiment of the antenna of the invention with its inside shown in part.

FIG. 1 shows a first embodiment of the invention in which the antenna scanned by frequency variation comprises two main portions, namely an exciter portion 10 and a radiating portion 20.

The description of this antenna is given essentially in terms of a transmitting antenna, but given the reciprocity theorem, it will naturally be understood that it is equally capable of operating, *mutatis mutandis*, as a receiving antenna, with the overall structure remaining unchanged.

Figure 2:
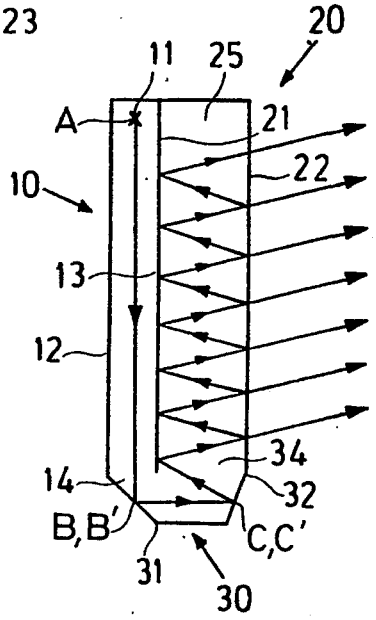
FIG. 2 is a diagrammatic vertical section through the FIG. 1 antenna (with directions being defined in non-limiting manner for convenience of description merely with reference to the conventions of the figure).

The exciter portion 10 includes at least one feed element 11 (the figure shows five feed elements 11*a* to 11*e* placed around a central point A) for emitting a radio wave between two parallel plane faces 12 and 13 (see cross-section of FIG. 2), with the wave front being perpendicular to the planes 12 and 13 and with the wave propagating towards an outlet end 14 of the exciter portion.

In order to avoid multiple reflections on the walls, an absorber 15 may be provided, if necessary and in conventional manner, to ensure that the wave follows a single path from the feed element 11 to the outlet end 14.

It may be observed that the faces 12 and 13 are not necessarily plane, they could have other configurations, depending on requirements (spherical, parabolic, shaped, etc).

In addition, the feed elements 11 need not necessarily be horns as shown, but could be constituted by any other known type of radiating element such as printed elements, wire radiating elements, etc. The multiple feed elements 11*a* to 11*e* need not necessarily all be identical, and they need not necessarily be distributed over a regular array.

The radiating portion 20 comprises two parallel surfaces 21 and 22 which are plane surfaces in the example shown. The surface 21 constitutes a ground plane while the surface 22 constitutes a front radiating surface.

It may be observed, here again, that these two parallel surfaces 21 and 22 need not necessarily be planar, and like the surfaces 12 and 13 of the exciter portion 10, they too may be planar, parabolic, spherical, etc. or may be shaped in any other suitable manner.

The wave produced by the exciter portion 10 (referred to in the claims as the exciter means) of the antenna is injected into the radiating portion 20 (referred to in the claims as the radiating means) at an incidence angle alpha via a focusing reflector member 30 comprising two focusing reflectors 31 and 32 which have intersections [cross sections] through a vertical plane [, i.e.,] such as the plane including points A, B and C in FIG. 1 (or the plane of the sheet in FIGS. 2 and 3), which are both rectilinear lines.

After being reflected at point C or C', the plane wave produced in this way strikes the ground plane 21 at a predetermined angle of incidence $\alpha$ (see diagram of FIG. 3), thereby causing the plane wave to be subjected to a multiple reflection phenomenon as it travels between the two parallel planes 21 and 22.

Since the radiating front plane 22 is a surface that is semipermeable to electromagnetic waves, e.g., because of perforations 23 formed through a metal plate, each time the wave strikes the front radiating plane 22 a portion of the energy in the wave passes through the plane and radiates to the outside, while the remainder of the energy is reflected back towards the ground plane 21 where it is again reflected towards the front plane, and so on.

In this example, the permeability of the front surface is essentially determined by the sizes and the spacing of the perforations 23, and is such as to ensure that the permeability is low in the bottom portion 24 where the energy density is higher (i.e., the perforations must be smaller in size in this region), and the permeability is high in the top portion 25 where the energy density is lower (i.e., the perforations should be larger in size in this region). The way in which the permeability varies is designed to ensure that the total energy leaking through the radiating front plane 22 produces the desired amplitude distribution.

Figure 3:
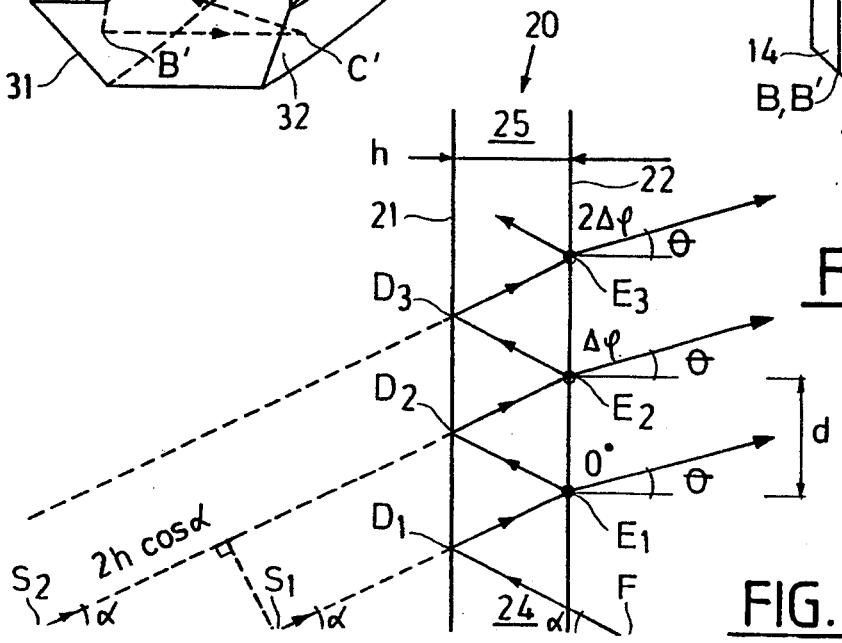
FIG. 3 shows how the antenna of the invention operates.

As described below with reference to FIG. 3, frequency scanning is based on the fact that the phase shift between two consecutive reflections on the radiating plane varies with frequency in accordance with the following equation:

$$\Delta\Phi=(2\pi/\lambda)\cdot(2h/\cos\alpha), \quad (1)$$

where:

$\lambda$ is the wavelength at frequency f;

h is the spacing between the ground plane and the radiating front plane;

$\alpha$ is the angle of incidence of the exciting wave; and $\Delta\Phi$ is the (accumulated) phase shift at each reflection.

The parameter h (the spacing between the two planes 21 and 22) can be selected in such a manner that the virtual images $S_1$, $S_2$, . . . of the focus F after successive reflections $D_1$, $E_1$, $D_2$, $E_2$, . . . satisfy the following equation:

$$2h\cos\alpha=m\lambda_0 \quad (2)$$

where m is a natural integer and $\lambda_0$ is the wavelength at the center operating frequency of the antenna.

The distance d between two adjacent reflection points $E_1$ and $E_2$ on the radiating front plane may be defined by the following equation:

$$d=2h\tan\alpha \quad (3)$$

The angle $\theta$ at which the main lobe is radiated can be calculated from the following equation which is itself known:

$$kd\sin\theta=\Delta\Phi-n\,2\pi \quad (4)$$

where k is a propagation constant and n is a natural integer.

By substituting the equations (1) through (3) into the above equation, the following is obtained:

$$\theta=\arcsin\,[(m-n(\lambda/\lambda_0)\cos^2\alpha)/(m\sin\alpha)] \quad (5)$$

The integers n and m are selected in such a manner as to ensure that the radiation angle $\theta$ is the same as the excitation angle $\alpha$ at the center frequency $f_0$, which occurs when n=m.

Equation (5) then becomes:

$$\theta=\arcsin\,[(1-(f_0/f)\cos^2\alpha)/(\sin\alpha)] \quad (6)$$

with the resultant $\theta$ varying as a function of frequency f, as desired.

Figure 4:
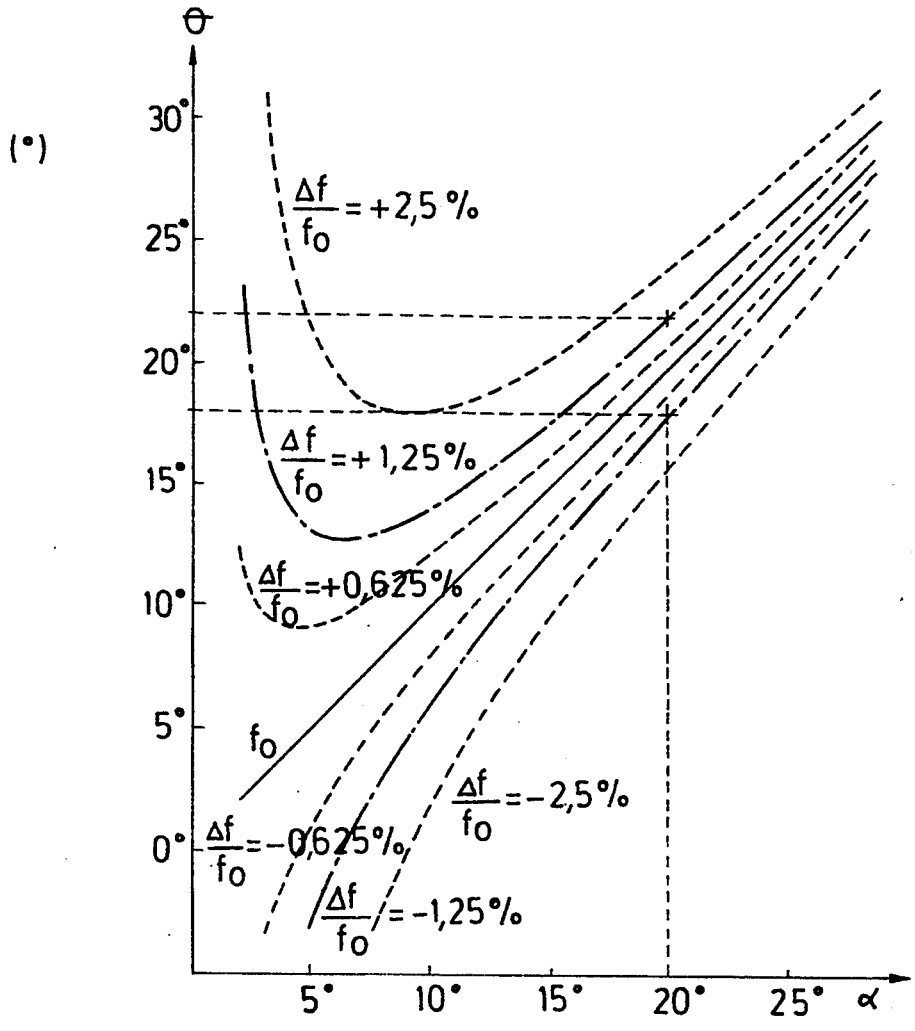
FIG. 4 is graph showing how the direction of the main lobe varies as a function of the angle of incidence of the wave in the radiating portion of the antenna, with the direction of the main lobe being shown for various different frequencies about the center operating frequency of the antenna.

FIG. 4 gives a network of curves showing how the direction of the main lobe varies as a function first of frequency f (or more precisely as a function of the frequency variation $\Delta f/f_0$ relative to the center frequency $f_0$), and second as a function of the angle of incidence $\alpha$.

As can be seen, frequency scanning sensitivity depends on the excitation angle $\alpha$ and has a relatively high value when the angle $\alpha$ is small.

This means that for a given frequency band, the total scan angle $\theta$ may be set by selecting the excitation angle $\alpha$. Although, in practice, there is a bottom limit for the excitation angle $\alpha$, it nevertheless remains true that frequency scanning is obtained having a large relative amplitude.

It is also possible to produce multiple beams in the plane perpendicular to the frequency scanning plane, by using a plurality of feed elements 11*a* to 11*ea* situated in the vicinity of the focus A, with each of the feed elements being slightly off-focus relative to the hyperbolic reflector 31.

Figure 5:
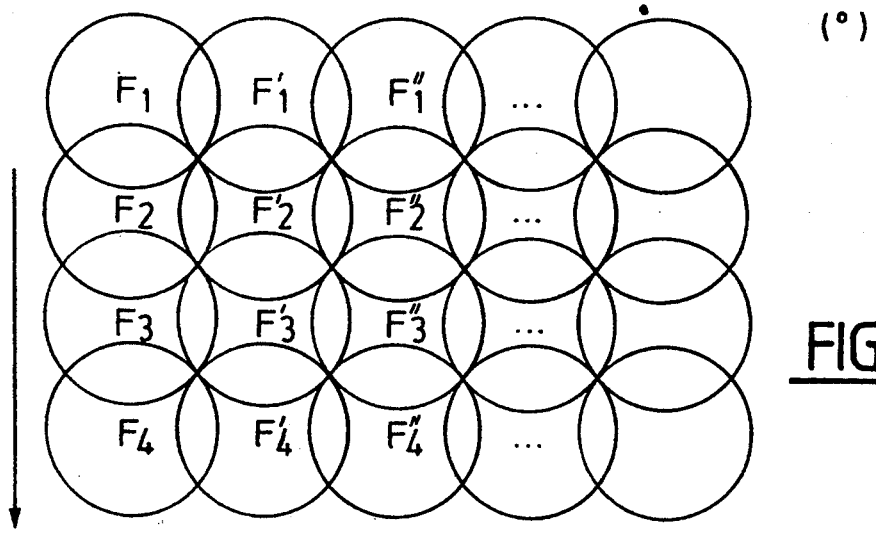
FIG. 5 shows how a geographical zone is scanned in two directions by combining the appropriate frequencies and feed horns.

Thus, by appropriately selecting feed horn and frequency combinations it is possible to obtain two-dimensional scanning, i.e., scanning in two perpendicular directions as shown in FIG. 5.

Advantageously, a small amount of overlap is then provided between adjacent beams so that the transition level between two adjacent beams is high enough (about 2.5 dB to 3 dB).

Such scanning may be used, in particular, to cover an extended geographical area over which satellite communications are to be provided.

For example, this would apply to telephone call services made available to passengers in aircraft. Such mobile radiotelephone services via satellite can be implemented in the 30/20 GHz band, where a bandwidth of 0.5 GHz may be allocated, thus corresponding to frequency variation of ±1.7% to ±2.5%. Unfortunately, in these frequency ranges, it is difficult using presently available apparatus to obtain a wide scan without using antennas that are complex and expensive to implement, e.g., antennas such as those described as prior art above.

In contrast, the present invention makes it possible to achieve frequency scanning having an amplitude of about 3° to 4° by suitably selecting frequencies in the available limits (0.5 GHz in the 30/20 GHz band), thus making it possible, for example, to provide full coverage of the North Atlantic which typically corresponds for a geostationary satellite to scanning through about 3° in the north/south direction (scanning performed by frequency variation) and about 7° to 8° in the east/west direction (with this scanning being obtained, for example, by means of eight selectable feed horns).

Such coverage thus corresponds to about 25 beams, leaving a bandwidth of about 20 MHz for each beam, which is sufficient bandwidth to make it possible to maintain several hundreds of channels per beam.

Figure 6:
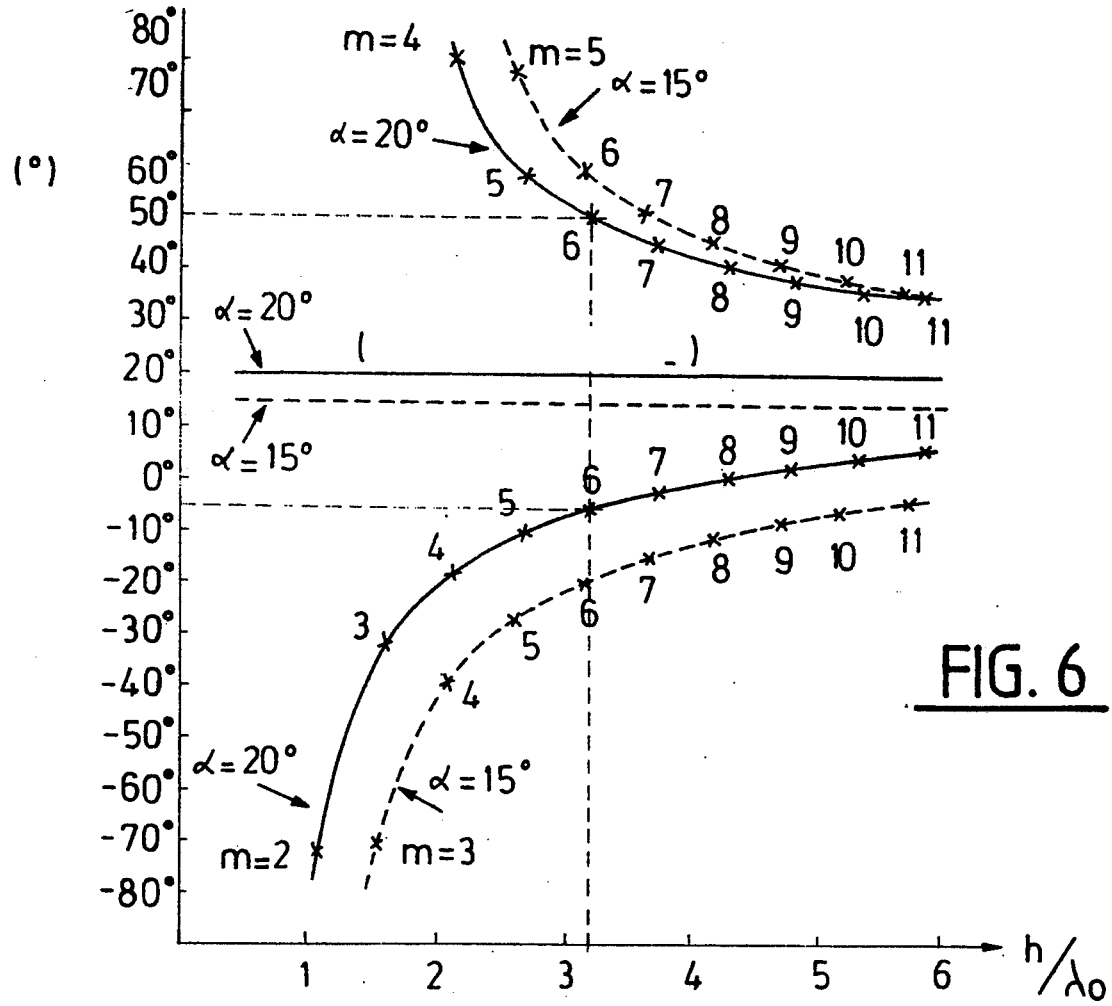
FIG. 6 is a graph showing the directions of the first secondary lobes relative to the main lobe as a function of the geometric characteristics of the antenna.

FIG. 6 shows the directions of the first secondary lobes (array lobes) which difference relative to the main lobe depends on the spacing between the virtual sources $S_1$, $S_2$, . . . .

The direction of the first secondary lobe on each side of the main lobe is given by equation:

$$\theta'=\arcsin\,[(\sin\theta\pm(f_0/f)\cos^2\alpha)/(m\sin\alpha)]. \quad (7)$$

FIG. 6 shows the positions of values $\theta'$ for various different values of m, and for two different values of the angle of incidence ($\alpha=15°$ and $\alpha=20°$ ).

It can thus be seen that the direction of the first secondary lobe depends on the spacing h between the ground plane and the radiating front plane such that if the ground plane and the radiating front planes are very close together, then the array lobes are distant from the main lobe.

Although, in practice, there is a lower limit on this spacing, a reasonable value is of the order of three times to four times the wavelength $\lambda_0$ at the center frequency, thus giving first array lobes offset by 20° to 30° from the main lobe. If the antenna is used on a geostationary satellite, these secondary lobes will lie outside Earth coverage, and will therefore give no interference, with the only drawback being the energy lost via such array lobes.

Numerous variants may be made on the above embodiment.

First, in the embodiments shown, the antenna operates in linear polarization. It is possible to provide for circular polarization merely by placing a phase shifter array in front of the radiating plane.

Instead of having circular perforations as in the embodiment shown it would also be possible in a variant embodiment for the radiating face to have rectangular perforations, elliptical perforations, rectilinear slots, cross-shaped slots, etc.

The radiating face may be constituted by a printed structure, e.g., by lines, by microstrip type elements such as rings, loops, crosses, etc., implemented in the form of one or more layers separated by a vacuum or by a dielectric.

The focusing reflectors 31 and 32 may have any appropriate shape: plane, hyperbolic, elliptical, parabolic, shaped, etc.; they may also be replaced by electromagnetic lenses.

The various feed elements 11*a* to 11*e* may be placed on a surface that is not necessarily plane, but which may be spherical, parabolic, shaped, etc.

Figure 7:
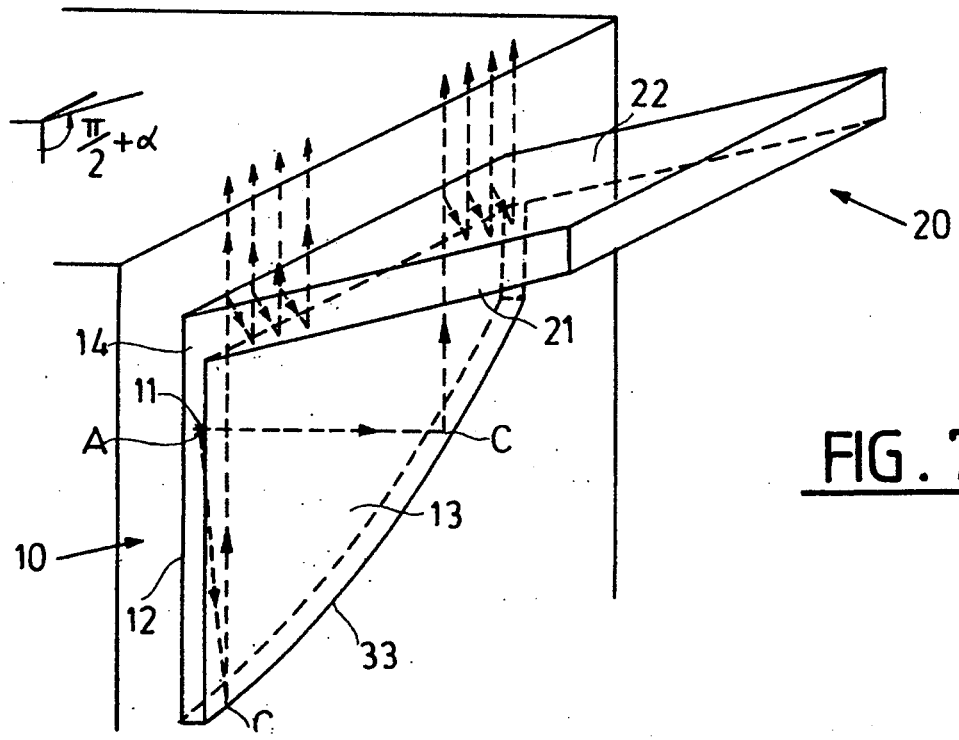
FIG. 7 is a perspective view of a second embodiment of an antenna of the invention.

Finally, FIG. 7 shows another embodiment in which the exciter portion 10 and the radiating portion 20 are no longer placed against each other as in FIG. 1, but are at a predetermined angle which corresponds exactly to the desired angle of incidence $\alpha$. As can be see in the figure, (in which numerical references identical to those of FIG. 1 designate similar items) only one reflector 33 is required in this case, which reflector is rectilinear in the frequency scanning plane and parabolic in the perpendicular plane.

We claim:

1. An antenna for radiating radio frequency electromagnetic energy emitted from an exciter, the direction of radiation being controllable by altering the frequency of said radio frequency electromagnetic energy about a design center frequency $f_0$ and a wavelength $\lambda_0$, comprising:

radiating means for receiving at an input a plane wave of radio frequency electromagnetic energy having frequency f and wavelength $\lambda$ and subjecting the plane wave to a plurality of successive reflections within said radiating means;

and wherein said radiating means includes first and second parallel reflecting members, where said first parallel reflecting member is at ground potential and serves also as a reference plane against which the incidence angle of incoming radio frequency energy at said input of said radiating means is measured, and wherein said first and second parallel reflecting members are spaced apart by a distance h greater than the wavelength $\lambda$ of said plane wave of radio frequency electromagnetic energy received at said input thereby causing a phase shift of said plane wave between two consecutive reflection points on said second parallel reflecting member, said phase shift varying as a function of the frequency f and wavelength $\lambda$ of plane wave, and wherein said second parallel reflecting member is permeable to radio frequency electromagnetic energy thereby allowing a fraction of the plane wave of radio frequency energy reflecting between said first and second parallel reflecting members to radiate to the outside after predetermined reflections in order to generate a set of radiated waves radiated from said radiating means, said set of radiated waves defining a transmission pattern having a main lobe whose direction is variable as a function of said frequency f and wavelength $\lambda$; and reflector means for receiving radio frequency energy at an input and reflecting said radio frequency energy as said plane wave into said input of said radiating means at a predetermined angle of incidence $\alpha$ to said first parallel reflecting member, and wherein said reflector means includes a hyperbolic reflector;

exciter means for receiving said radio frequency electromagnetic energy from said exciter at an input near the focal point (A) of said hyperbolic reflector and directing said radio frequency electromagnetic energy into said input of said reflector means; and a plurality of feed horns located near said focal point (A) each of which is slightly away from said focal point (A) spatially offset from the other, and each of which may be selected to couple energy from said exciter into said exciter means thereby enabling two dimensional scanning by selection of an appropriate combination of feed horn and frequency of radio frequency electromagnetic energy, and wherein the angle of radiation of said set of radiated waves $\theta$ is governed by the following relationship $$\theta = \arcsin\{(m - n(\lambda/\lambda_0)\cos^2\alpha)/(m\sin\alpha)\}$$

where $\theta$ = the angle of radiation of said main lobe relative to said second parallel reflecting surface;

$\lambda$ = the wavelength of the radio frequency electromagnetic energy received from said exciter;

$\lambda_0$ = the wavelength of the design center frequency for operation of said antenna in radiating radio frequency electromagnetic energy received from said exciter;

$\alpha$ = the angle of incidence of said plane wave of radio frequency electromagnetic energy into said radiating means relative to said reference plane; and m and n are integers selected in such a manner that the radiation angle $\theta$ equals the angle of incidence $\alpha$ at said design center frequency having wavelength $\lambda_0$.

2. An antenna according to claim 1, wherein said radiating means and said reflector means cooperate to cause a phase shift between two consecutive reflections on said second parallel reflector member according to equation (1) below:

$$\Delta\Phi = (2\pi/\lambda)(2h/\cos\alpha) \quad (1)$$

where $\Delta\Phi$ = the accumulated phase shift between two consecutive reflections on said second parallel reflecting member, $\lambda$ = the wavelength of the radio frequency electromagnetic energy received from said exciter, h = the spacing between the first and second parallel reflecting members, and $\alpha$ = the angle of incidence of the plane wave of radio frequency electromagnetic energy arriving at said input of said radiating means relative to said first parallel reflecting member.

3. An antenna according to claim 1, wherein said first and second parallel reflecting members are planar.

4. An antenna according to claim 2, in which said exciter means comprises two waveguide surfaces, said waveguide surfaces disposed in such a manner relative to each other as to guide radio frequency electromagnetic energy arriving from said exciter to said reflector means.

5. An antenna according to claim 4, in which said exciter is coupled to feed element means forming part of said exciter means, for selectively introducing into said exciter means different beams from said exciter having respective different directions.

6. An antenna according to claim 5, wherein said first reflecting member is at ground potential and wherein said second parallel reflecting member has a plurality of perforations therein such that a portion of the radio frequency energy which impinges on said second parallel reflecting member passes through said perforations and is radiated by said second parallel reflecting member to the outside, and wherein the permeability of said second parallel reflecting member to radio frequency energy is lower in the region of said second parallel reflecting member near said input of said radiating means than in region of said second parallel reflecting member further from said input of said radiating means.

7. An antenna for radiating radio frequency electromagnetic energy emitted from an exciter, the direction of radiation being controllable by altering the frequency of said radio frequency electromagnetic energy about a center frequency $f_0$, comprising:

radiating means for receiving at an input a plane wave of radio frequency electromagnetic energy having frequency f and wavelength λ and subjecting the plane wave to a plurality of successive reflections within said radiating means, and wherein said radiating means includes first and second parallel reflecting members, where said first parallel reflecting member is at ground potential and serves also as a reference plane against which the incidence angle of incoming radio frequency energy at said input of said radiating means is measured, and wherein said first and second parallel reflecting members are spaced apart by a distance h greater than the wavelength of said plane wave of radio frequency electromagnetic energy received at said input thereby causing a phase shift of the plane wave of radio frequency electromagnetic energy received at said input of said radiating means at a given frequency f between two consecutive reflection points on said second parallel reflecting member, said phase shift varying as a function of the frequency f of the plane wave of radio frequency energy received at said input, and wherein said second parallel reflecting member is permeable to radio frequency electromagnetic energy thereby allowing a fraction of the plane wave of radio frequency energy reflecting between said first and second parallel reflecting members to radiate to the outside after predetermined reflections in order to generate a set of radiated waves radiated from said radiating means, the set of radiated waves produced in this manner having a direction of radiation relative to said second parallel reflecting member which is variable as a function of the frequency f of the radio frequency energy generated by the exciter, and reflector means for receiving said radio frequency energy having frequency f and wavelength λ at an input and reflecting said radio frequency energy as a plane wave into said input of said radiating means at a predetermined angle of incidence α to said first parallel reflecting member;

exciter means for receiving said radio frequency electromagnetic energy having frequency f and wavelength λ from said exciter at an input near the focal point (A) of said reflector means and directing said radio frequency electromagnetic energy into said input of said reflector means; and wherein said radiating means and said reflector means cooperate to cause a phase shift between two consecutive reflections on said second parallel reflector member according to equation (1) below:

$$\Delta\Phi=(2\pi/\lambda)(2h/\cos\alpha) \quad (1)$$

where

ΔΦ=the accumulated phase shift between two consecutive reflections on said second parallel reflecting member, λ=the wavelength of the radio frequency electromagnetic energy received from said exciter, h=the spacing between the first and second parallel reflecting members, and α=the angle of incidence of the plane wave of radio frequency electromagnetic energy arriving at said input of said radiating means relative to said first parallel reflecting member, and wherein said second parallel reflecting member is provided with perforations to make it permeable to radio frequency electromagnetic waves, and wherein permeability of said second parallel reflecting member to radio frequency electromagnetic radiation varies with position on said second parallel reflecting member, permeability to radio frequency energy being low in regions near said input where said radio frequency electromagnetic energy enters said radiating means from said exciter means and where power density of the plane wave radio frequency electromagnetic energy being reflected between said first and second parallel reflecting members is high, and wherein permeability of said second parallel reflecting member to radio frequency electromagnetic energy is higher in regions farther from said input of said radiating means where said power density of said radio frequency electromagnetic energy is lower.

8. An antenna for radiating radio frequency electromagnetic energy emitted from an exciter, the direction of radiation being controllable by altering the frequency of said radio frequency electromagnetic energy about a center frequency $f_0$, comprising:

radiating means for receiving at an input a plane wave of radio frequency electromagnetic energy having frequency f and wavelength λ and subjecting the plane wave to a plurality of successive reflections within said radiating means, and wherein said radiating means includes first and second parallel reflecting members, where said first parallel reflecting member is at ground potential and serves also as a reference against which the incidence angle of incoming radio frequency energy at said input of said radiating means is measured, and wherein said first and second parallel reflecting members are spaced apart by a distance h greater than the wavelength λ of said plane wave of said radio frequency electromagnetic energy received at said input thereby causing a phase shift of the plane wave of radio frequency electromagnetic energy received at said input of said radiating means at a given frequency f between two consecutive reflection points on said second parallel reflecting member, said phase shift varying as a function of the frequency f and wavelength λ of the plane wave of radio frequency energy received at said input, and wherein said second parallel reflecting member is permeable to radio frequency electromagnetic energy thereby allowing a fraction of the plane wave of radio frequency energy reflecting between said first and second parallel reflecting members to radiate to the outside after predetermined reflections in order to generate a set of radiated waves radiated from said radiating means, the set of radiated waves produced in this manner having a direction of radiation relative to said second parallel reflecting member which is variable as a function of the frequency f and wavelength λ of the radio frequency energy generated by the exciter, and reflector means for receiving said radio frequency energy of frequency f and wavelength λ at an input and reflecting said radio frequency energy as a plane wave into said input of said radiating means at a predetermined angle of incidence α to said first parallel reflecting member;

exciter means for receiving said radio frequency electromagnetic energy of frequency f and wavelength λ from said exciter at an input near the focal point (A) of said reflector means and for directing said radio frequency electromagnetic energy into said input of said reflector means; and wherein said radiating means and said reflector means cooperate to cause a phase shift between two consecutive reflections on said second parallel reflector member according to equation (1) below:

$$\Delta\Phi=(2\pi/\lambda)(2h/\cos\alpha) \quad (1)$$

where $\Delta\Phi$=the accumulated phase shift between two consecutive reflections on said second parallel reflecting member, λ=the wavelength of the radio frequency electromagnetic energy received from said exciter, h=the spacing between the first and second parallel reflecting members, and α=the angle of incidence of the plane wave of radio frequency electromagnetic energy arriving at said input of said radiating means relative to said first parallel reflecting member, and wherein said reflector means comprises a first focussing reflector surface which is planar with respect to a first predetermined axis and hyperbolic with respect to a second predetermined axis orthogonal to said first predetermined axis, and a second focussing reflector surface which is planar with respect to a third predetermined axis and parabolic with respect to a fourth predetermined axis orthogonal to said third predetermined axis.

9. An antenna for radiating radio frequency electromagnetic energy from a transmitter, the direction of radiation being controllable by altering the frequency of said electromagnetic energy about a design center frequency $f_0$, comprising:

exciter means for receiving said radio frequency electromagnetic energy having a frequency f and a wavelength λ from said transmitter and directing said electromagnetic energy to an output;

reflector means coupled to said exciter means for receiving said radio frequency electromagnetic energy from the output of said exciter means and converting said radio frequency electromagnetic energy into a plane wave of electromagnetic energy and outputting said plane wave of electromagnetic energy at a predetermined injection angle α relative to a reference plane;

radiating means including said reference plane and coupled to said reflector means for receiving at an input said plane wave of electromagnetic energy from said reflector means and subjecting said plane wave to a plurality of successive reflections within said radiating means between at least first and second parallel reflecting surfaces separated by a distance h, and at least one of which has perforations which render it permeable to radio frequency electromagnetic energy, such that a fraction of the plane wave of electromagnetic energy radiates to the outside after predetermined reflections within said radiating means, and wherein said reflector means guides said radio frequency electromagnetic energy into said radiating means at said injection angle α such that the angle of radiation of a main lobe of radiation comprised of radio frequency electromagnetic energy which has escaped through said perforations can be controlled through alteration of the frequency f of said radio frequency electromagnetic energy arriving from said transmitter according to the following relationship:

$$\theta=\arcsin\{(m-n(\lambda/\lambda_0)\cos^2\alpha)/(m\sin\alpha)\}$$

where

θ=the angle of radiation of said main lobe relative to said second parallel reflecting surface;

λ=the wavelength of the radio frequency electromagnetic energy received from said transmitter;

$\lambda_0$=the wavelength of the design center frequency for operation of said antenna in radiating radio frequency electromagnetic energy received from said transmitter;

α=the injection angle of said plane wave of radio frequency electromagnetic energy into said radiating means relative to said reference plane; and m and n are integers selected in such a manner that the radiation angle θ equals the injection angle α at said design center frequency having wavelength $\lambda_0$;

and wherein said reflector means includes a hyperbolic reflector and a parabolic reflector, said hyperbolic and parabolic reflectors cooperating to convert the radio frequency electromagnetic energy arriving from said exciter means into an accurate plane wave for injection into said reflector means, said reflector means having a focal point (A) near an input to said exciter means, and further comprising a plurality of feed horns coupled to direct radio frequency electromagnetic energy received from said transmitter into said exciter means, said feed horns located in the vicinity of said focal point (A) with each feed horn slightly off focus relative to said hyperbolic reflector of said reflector means, and wherein each feed horn may be selectively used to couple radio frequency electromagnetic energy from said transmitter into said exciter means thereby enabling two-dimensional scanning of the angle of radiation by proper selection of feed horn and the frequency of the radio frequency electromagnetic energy fed into it.

* * * * *